US007640075B2

(12) United States Patent
Wietgrefe

(10) Patent No.: US 7,640,075 B2
(45) Date of Patent: Dec. 29, 2009

(54) APPARATUS AND METHOD FOR COORDINATING AUTOMATED PACKAGE AND BULK DISPENSING

(75) Inventor: Gary W. Wietgrefe, Sioux Falls, SD (US)

(73) Assignee: Syngenta Participations AG, Basel (CH)

( * ) Notice: Subject to any disclaimer, the term of this patent is extended or adjusted under 35 U.S.C. 154(b) by 320 days.

(21) Appl. No.: 11/332,963

(22) Filed: Jan. 17, 2006

(65) Prior Publication Data

US 2007/0005186 A1 Jan. 4, 2007

Related U.S. Application Data

(60) Provisional application No. 60/696,086, filed on Jul. 2, 2005.

(51) Int. Cl.
*G06F 17/00* (2006.01)

(52) U.S. Cl. ..... 700/237; 700/236; 700/244; 198/550.01; 198/550.2; 198/532; 198/530

(58) Field of Classification Search ..... 198/530, 198/532, 550.01, 550.2; 700/237, 236, 244
See application file for complete search history.

(56) References Cited

U.S. PATENT DOCUMENTS

| | | | | |
|---|---|---|---|---|
| 3,942,689 | A | 3/1976 | Dakin, Jr. et al. | |
| 4,176,767 | A | 12/1979 | Franche, IV | |
| 4,189,262 | A | 2/1980 | Anderson | |
| 4,934,569 | A | 6/1990 | Womack, Jr. et al. | |
| 5,697,535 | A * | 12/1997 | Coleman | 222/542 |

(Continued)

FOREIGN PATENT DOCUMENTS

| | | |
|---|---|---|
| DE | 2942308 | 5/1981 |

(Continued)

OTHER PUBLICATIONS

Buckhorn—Center Flow Container Seed Box [online]. Buckhorn, Inc. [retrieved on Jun. 27, 2005]. Retrieved from the Internet: http://www.buckhorninc.com/products /cbb/cbb_11.html.

(Continued)

*Primary Examiner*—Gene Crawford
*Assistant Examiner*—Timothy R Waggoner
(74) *Attorney, Agent, or Firm*—Bruce Vrana

(57) ABSTRACT

An apparatus and method is provided for coordinating automated package and bulk dispensing at a remote site. A hopper apparatus includes a series of storage compartments and access doors. The compartments and doors are linked to a PLC that is further linked to an inventory provider. The inventory provider takes product orders from an end-user. The end-user is provided an end-user access code. The inventory provider communicates with the PLC and reserves for the ordered product(s) a vacant storage compartment(s). The inventory provider delivers the product(s) ordered by the end-user to the hopper apparatus. Upon delivery, the inventory provider enters the appropriate end-user access code(s), causing the PLC to open the storage compartment(s) previously reserved by the inventory provider for the products ordered by the end-user. The inventory provider loads the appropriate storage compartment(s) with the end-user product(s). The end-user subsequently picks up product(s) previously ordered by entering in his or her access code(s).

13 Claims, 14 Drawing Sheets

U.S. PATENT DOCUMENTS

| | | | | |
|---|---|---|---|---|
| 5,829,616 | A * | 11/1998 | Daniel et al. | 220/651 |
| 5,878,402 | A * | 3/1999 | Brewster et al. | 705/29 |
| 6,188,936 | B1 | 2/2001 | Maguire et al. | |
| 6,560,700 | B1 * | 5/2003 | Birkler et al. | 707/201 |
| 6,774,318 | B2 * | 8/2004 | Beal et al. | 222/561 |
| 2001/0011437 | A1 | 8/2001 | Shortridge et al. | 47/58.1 |
| 2005/0004682 | A1 | 1/2005 | Gaddis et al. | 700/9 |
| 2005/0092389 | A1 | 5/2005 | Mazur et al. | 141/100 |

FOREIGN PATENT DOCUMENTS

| | | |
|---|---|---|
| EP | 1362802 | 11/2003 |
| GB | 831277 | 3/1960 |
| JP | 2001-180789 | 7/2001 |
| WO | WO 02/21402 A1 | 3/2002 |

OTHER PUBLICATIONS

Buckhorn, Inc., Center Flow Container [brochure].

Buckhorn, Inc., Center Flow Seedbox™ [brochure].

AG Partners LLC. Bulkseed.com [online]. [retrieved on Jun. 27, 2005]. Retrieved from the Internet: http://agpartners.com/bulkseed/seed_retailers.htm.

Friesenusa.com—Bulk Seed Handling [online]. Friesen USA, Inc. [retrieved on Jun. 27, 2005]. Retrieved from the Internet: http://friesenusa.com/bulk.seed.handling.htm.

"Design for popular PROBOX™ bulk seed handling system available to seed industry. Pioneer system offers growers improved efficiency and convenience." Des Moines, Iowa, Mar. 11, 1999, SeedQuest [online]. [retrieved on Jun. 27, 2005]. Retrieved from the Internet: http://seedquest.com/News/releases/usa/Pioneer/N1618.htm.

SHAPA Technical Bulletin No. 12, "Discharge Aids," Aug. 2007.

* cited by examiner

APPARATUS AND METHOD FOR COORDINATING AUTOMATED PACKAGE AND BULK DISPENSING

This application is a continuation in part of U.S. Provisional Application Ser. No. 60/696,086, filed Jul. 2, 2005, the specification of which is herein incorporated by reference.

FIELD OF THE INVENTION

An apparatus and method for the self-service, automatic distribution of bulk and package products, including bulk seed, packaged seed, and packaged chemicals to an end-user.

BACKGROUND OF THE INVENTION

Current systems for distribution of products to end-users typically require dealers and distributors to hand deliver the products to the end-user or use a vending machine, where end-users select the product previously loaded into the vending machine. For delivery directly by a dealer, distributor, or other transferring entity (dealer), end-users must typically take possession of products during the hours that the dealer is open for business. Distribution of bulk and packaged products is done manually. By way of example, for bulk plant seed, a dealer will typically transfer the seed from the dealer's storage container into a grower's container, such as a truck box, seed wagon or seed tender unit. Alternatively, the dealer may transfer its storage container containing the product directly to the grower. The grower then transports the product in the storage container to its end use. Allowing the end-user or grower to carry away the storage containers requires that the dealer stock a large number of often very expensive storage containers. The growers often keep the containers until after the planting season, making them unavailable for further use by the dealer that season.

To best serve its end-users, dealers will typically pay workers significant overtime to keep a facility open and to deliver products to the end-users before and after hours. This is especially true for dealers of agricultural products.

A particular storage container used in numerous industries is referred to as a "hopper." A hopper is a funnel-shaped container in which materials, including such things as seed, grain, coal, or fuel are stored in readiness for dispensation. Freight trucks and trains often store, transport and dispense materials using hoppers. Hopper dispensing doors or gates are typically flat and are located at the bottom end of the funnel-shaped hopper. A recurring problem occurs during dispensation due to the crusting or bridging of the stored materials at the bottom of the hopper due to gravity compaction of the stored material. Typical unblocking solutions are to use poles, hammers, and other similar tools to manually stir or otherwise break up the blockage. These methods take time and can cause injury to the person trying to unblock the blocked material and can cause harm to the hopper itself.

To date, there is no apparatus and method that provides for receiving orders for products and subsequently providing an automatic, all-time delivery of the products to the end-user at a remote site. There is also no method or apparatus for automatically dislodging stored material that has compacted and lodged itself at the bottom opening of the hopper.

SUMMARY OF THE INVENTION

The present disclosure provides an apparatus and method for self-service, automatic, all-time delivery of products to an end-user at a remote site. The apparatus and method of the disclosure are capable of operating to dispense numerous different types of bulk and packaged products, including, but not limited to, plant seed such as corn and soybean seed, pesticides, oil, hydraulic fluid, gasoline, fertilizer, tires, equipment, parts, and other supplies, wherein such products are delivered to the apparatus of the disclosure according to a specific order by an end-user and stored for pick-up. End-user pick-up of the ordered goods is by self-service and, therefore, can happen any day or time. The end-user enters into a processing device, such as a programmable logic control (PLC) device, the specific end-user access code, whereupon the PLC releases the product from the assigned storage compartment (s) and the end-user takes delivery.

In more detail, the apparatus of the present disclosure is referred to as a "hopper apparatus." The hopper apparatus includes a number of different product storage areas, some of which are contiguous with or feed into hoppers. These storage areas are capable of holding large storage containers and products stored in bulk (bulk product), such as plant seed, grain, chemicals, coal, and other materials. The hopper apparatus of the disclosure also includes areas for storing goods that are pre-packaged, such as bagged seed or chemicals that may or may not be stored on pallets.

The hopper apparatus of the disclosure is typically located at a site remote from the entity allowed to provide inventory to the structure, such as a product dealer, distributor, or the like. For present purposes, this entity is referred to as an "inventory provider." The hopper apparatus further includes a PLC and a printer linked to the PLC. The PLC, having a user interface, such as a key pad and/or touch screen, is capable of sending to and receiving data from the inventory provider and is further capable of receiving data via the user interface from, and sending data to, an end-user. In one embodiment of the disclosure, an inventory provider receives a product order from an end-user and communicates with the PLC. The PLC indicates to the inventory provider the vacant storage areas. The inventory provider requests the PLC to reserve selected storage areas for particular packaged and/or bulk products to be delivered to an end-user, providing the PLC with a code identifying the particular end-user. The inventory provider subsequently delivers to the hopper apparatus of the disclosure the product(s) and amount ordered by the end-user and inserts the product into the previously reserved storage area (s) of the hopper apparatus. The end-user subsequently receives delivery of the product by entering his code into the PLC. The PLC will inform the end-user which storage compartment(s) or conveyor from which to obtain the product(s). The end-user can only receive product from one compartment at a time, and therefore indicates to the PLC that he or she is ready for delivery of the first product, upon which title to that product automatically passes to the end-user. The PLC releases the product from the assigned storage compartment and the end-user takes delivery. The end-user repeats the process until the product from each storage compartment corresponding to the end-user code is delivered to the end-user.

The hopper apparatus of the disclosure also includes a unique hopper gate also referred to herein as a "slide gate." The slide gate, upon sliding to its open position, simultaneously dislodges crusted, bridged, or otherwise blocked material, allowing such material to freely exit the hopper.

DETAILED DESCRIPTION OF THE INVENTION

In the Figures, the first digit of a reference number refers to the Figure in which it is used, while the remaining two digits of the reference number refer to the same or equivalent parts of embodiment(s) of the present disclosure used throughout the several figures of the drawings. The scaling of the figures does not represent precise dimensions of the various elements illustrated therein.

The present disclosure relates to an apparatus and method for self-service, automatic distribution of bulk and package products. In the embodiment described herein, the products ordered, delivered and distributed according to the apparatus and method of the present disclosure are agricultural products, including bulk seed, seed pre-packaged in large containers or bags, and pre-packaged chemicals. Other agricultural products also may be distributed according to the present disclosure, including such things as equipment, hydraulic fluid, and the like. The apparatus and method of the present disclosure may be used for products and distribution systems of other industries. For example, certain aspects of the disclosure may be particularly relevant to the freight truck and train transport industry.

Figure 1:
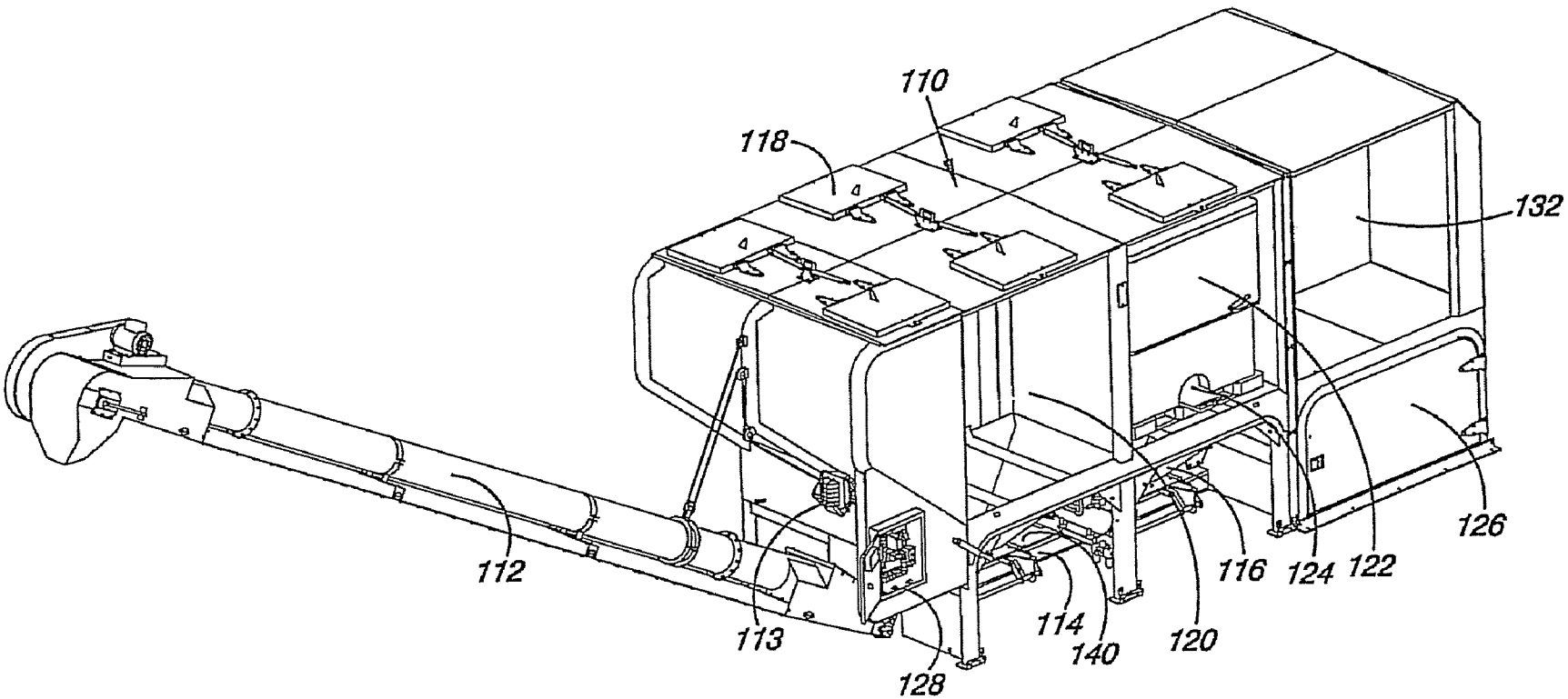
FIG. 1 illustrates an embodiment of an apparatus suitable to facilitate dispensing of products, according to embodiments of the present disclosure.

Referring to FIG. 1, the hopper apparatus 110 of the disclosure provides for automatic all-time delivery of product to an end-user at a remote site. Hopper apparatus 110 includes a number of different product storage receptacles, including an integral large container/bulk storage receptacle 120, referred to hereinafter as the "receptacle." Receptacle 120 accepts container 122, such as a center flow container manufactured by Buckhorn Inc. Another container that is compatible with the hopper apparatus of the disclosure is the Q-Bit PLUS™ container. Receptacle 120 may also accept similar containers that have off-center bottom openings, such as bottom openings located at a bottom corner of the container. An off-center bottom opening container known to the industry is the Q-Bit™ container.

Figure 2:
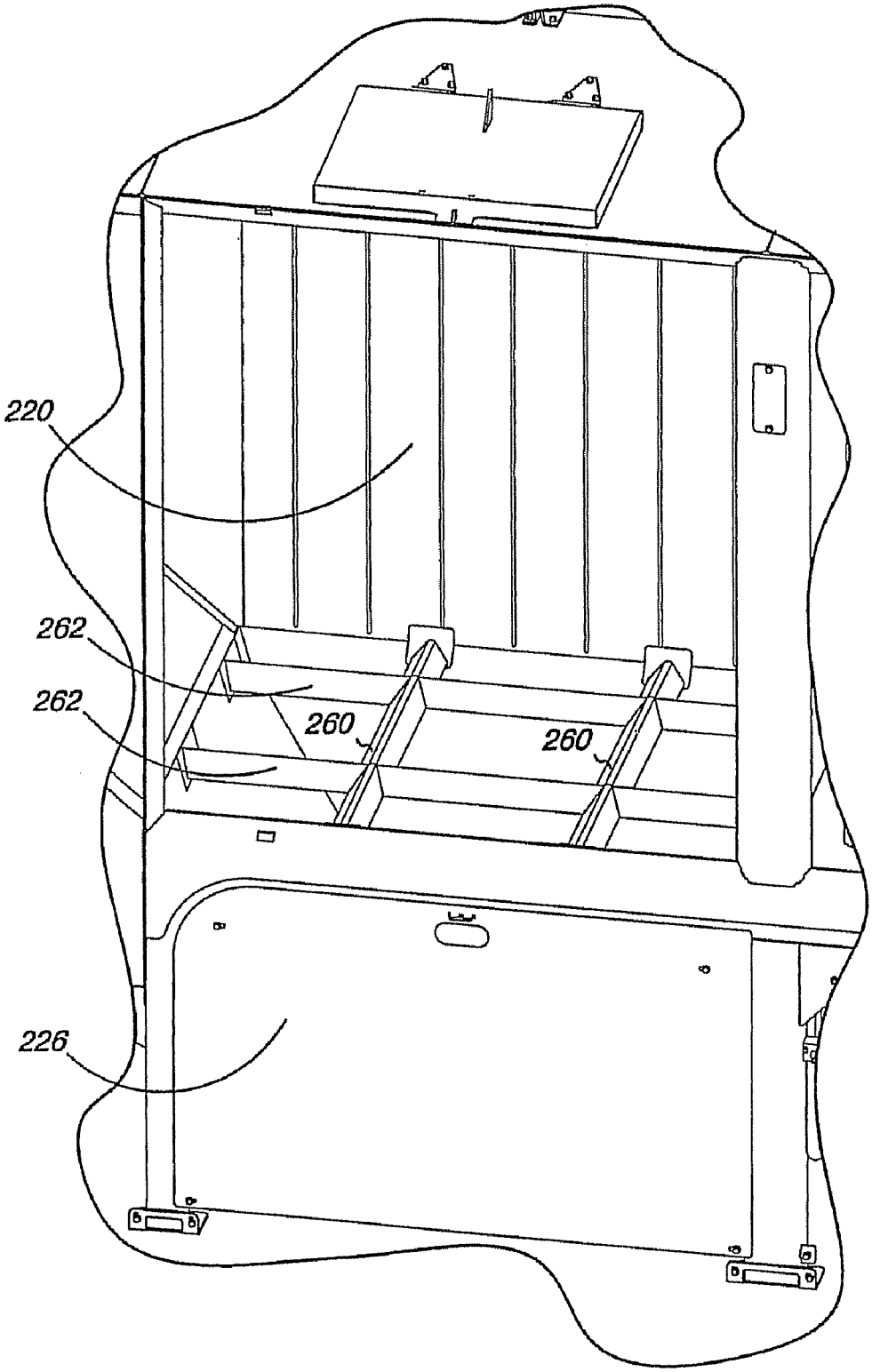
FIG. 2 illustrates an embodiment of a product package support base within a storage receptacle of the product dispensing apparatus.

FIG. 2 shows receptacle 220 and a product package support base comprising two or more container support rails 260 and two or more floor support rails 262. The rails 260 and 262 are beveled so that non-packaged bulk product, such as grain, falls into the hopper without collecting on rails 260 and 262. "Product package support base" refers to a base that bears products residing within a package or packages, such as container 220, individual product bags, a pallet of packaged products, or any other form or configuration of packaged product. The product package support base of the disclosure allows receptacle 220 to be used for bulk storage or for storage of packaged product.

In one embodiment, floor support rails 262 are positioned so that their top surface is slightly below the top surface of support rails 260, allowing such things as pallets (not shown) and containers such as container 122 to slide on container support rails 260 without catching on intersecting rails 262. Other support bases may be used according to the present disclosure, provided such bases do not encumber loading of material and containers, pallets, and other product packages into receptacle 220, are able to hold substantial weight, and allow bulk material to flow unimpeded into hopper 116 and receptacle 220.

Figure 3:
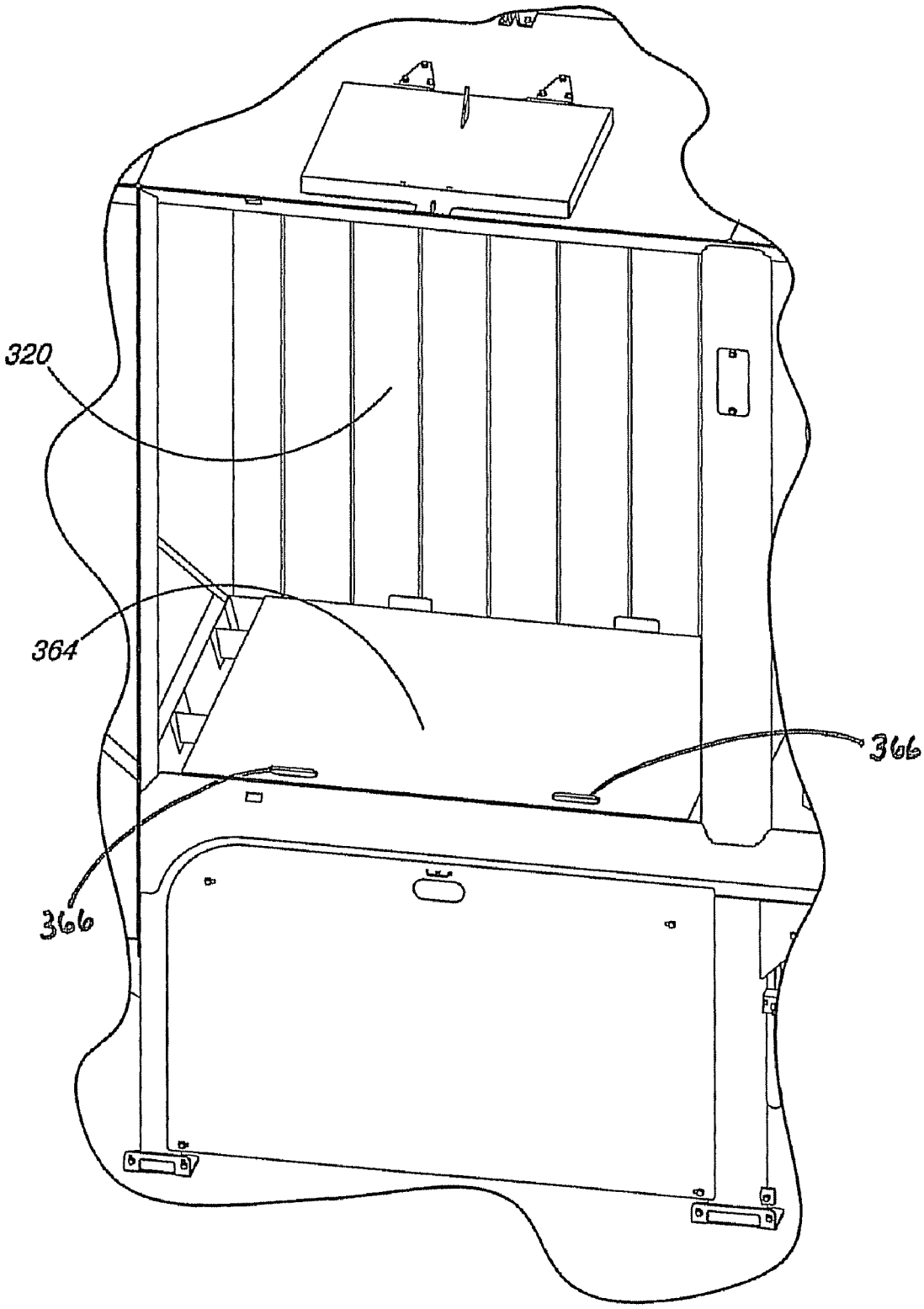
FIG. 3 illustrates an embodiment of a removable floor positioned within a storage receptacle of the product dispensing apparatus.

The present disclosure also includes a removable floor 364 having hand holds 366 as shown in FIG. 3. Removable floor 364 can be inserted into receptacle 320 and placed on top of rails 260 and 262 shown in FIG. 2. Removable floor 364 provides more storage flexibility for the hopper system by allowing users to store bags and packaged items in receptacle 320. When removable floor 364 is not in use, it may be stored and locked on any appropriate unused surface, e.g., receptacle 320, or within any available space thereof.

Figure 4:
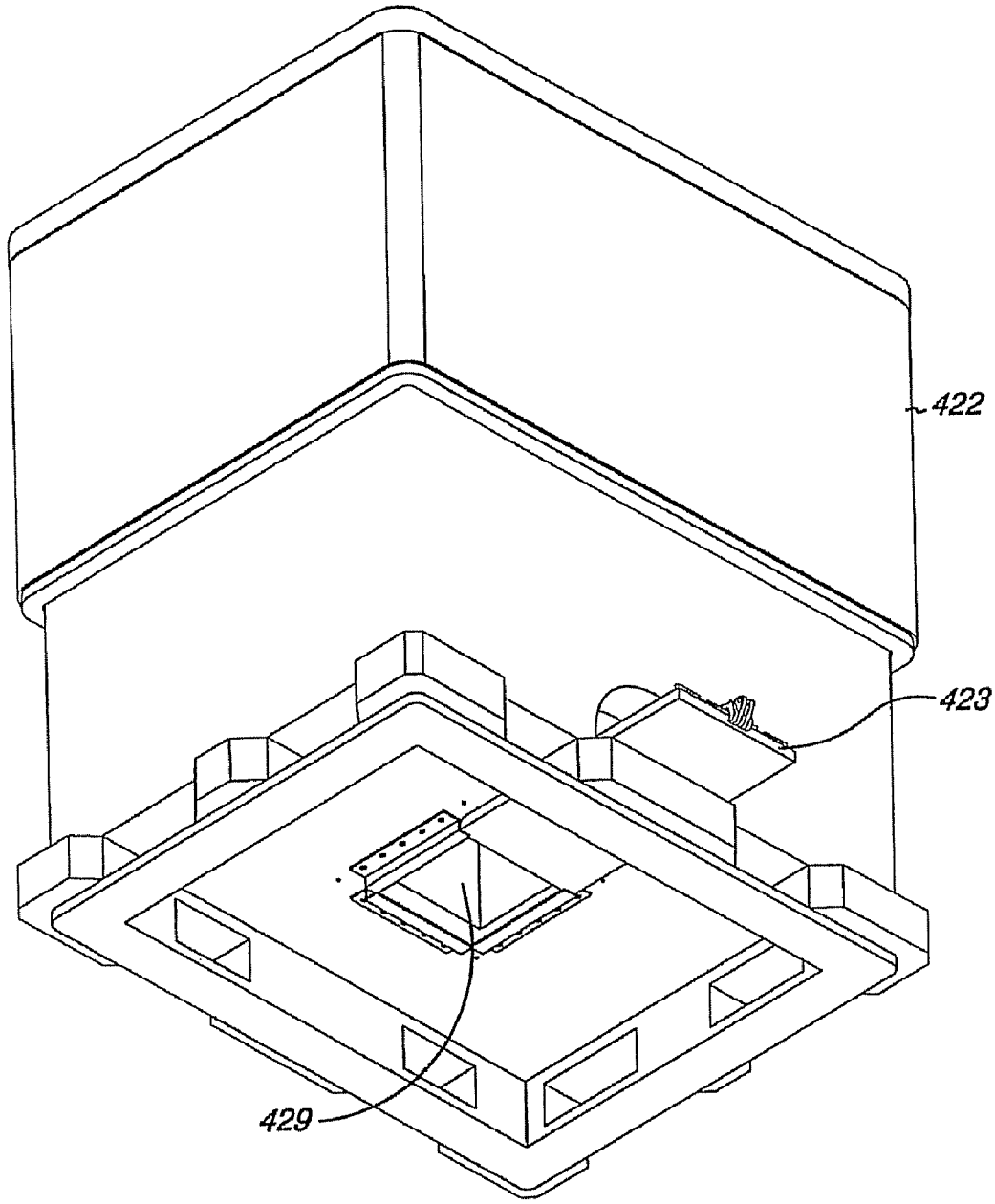
FIG. 4 illustrates an embodiment of a product container for placement within a storage receptacle of the product dispensing apparatus.
Figure 5A:
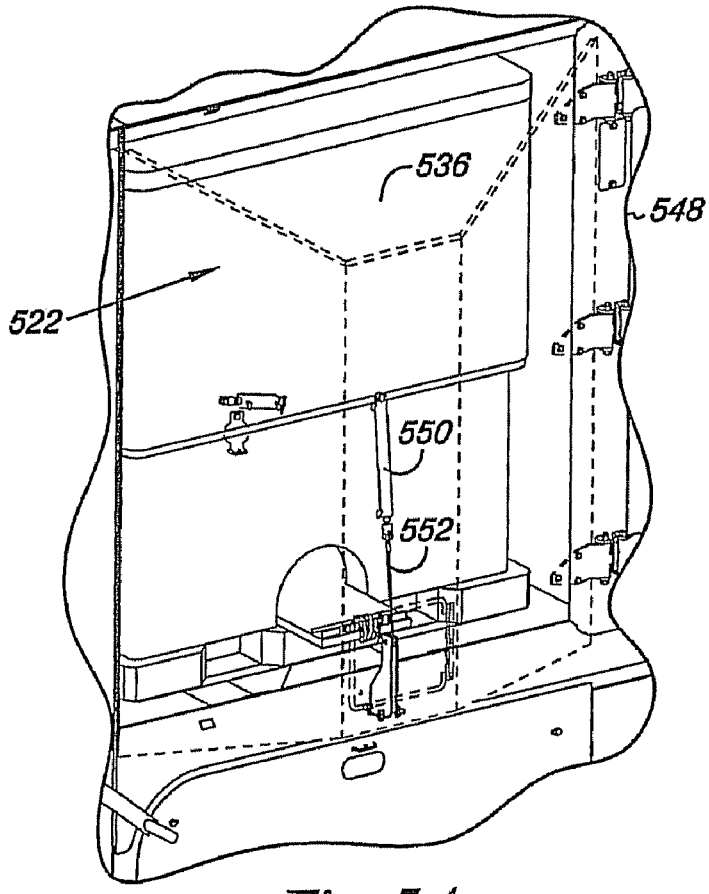
FIGS. 5A and 5B illustrate embodiments of a cable and pulley device for allowing exit of product from a storage receptacle of the product dispensing apparatus.
Figure 5B:
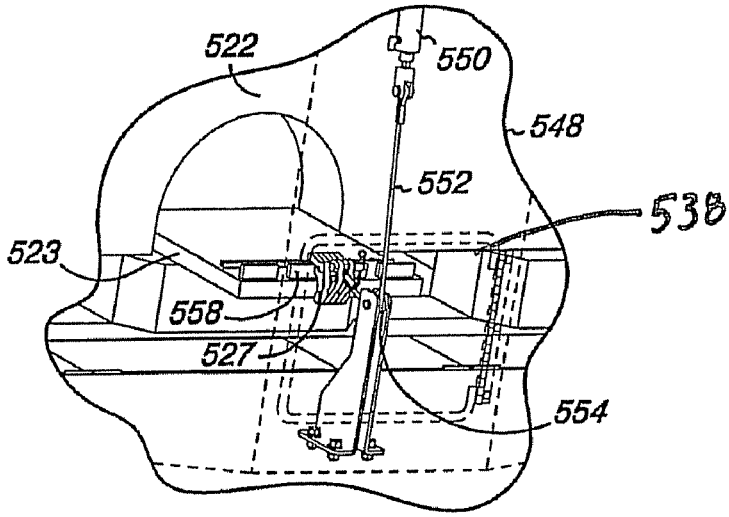
Figure 6:
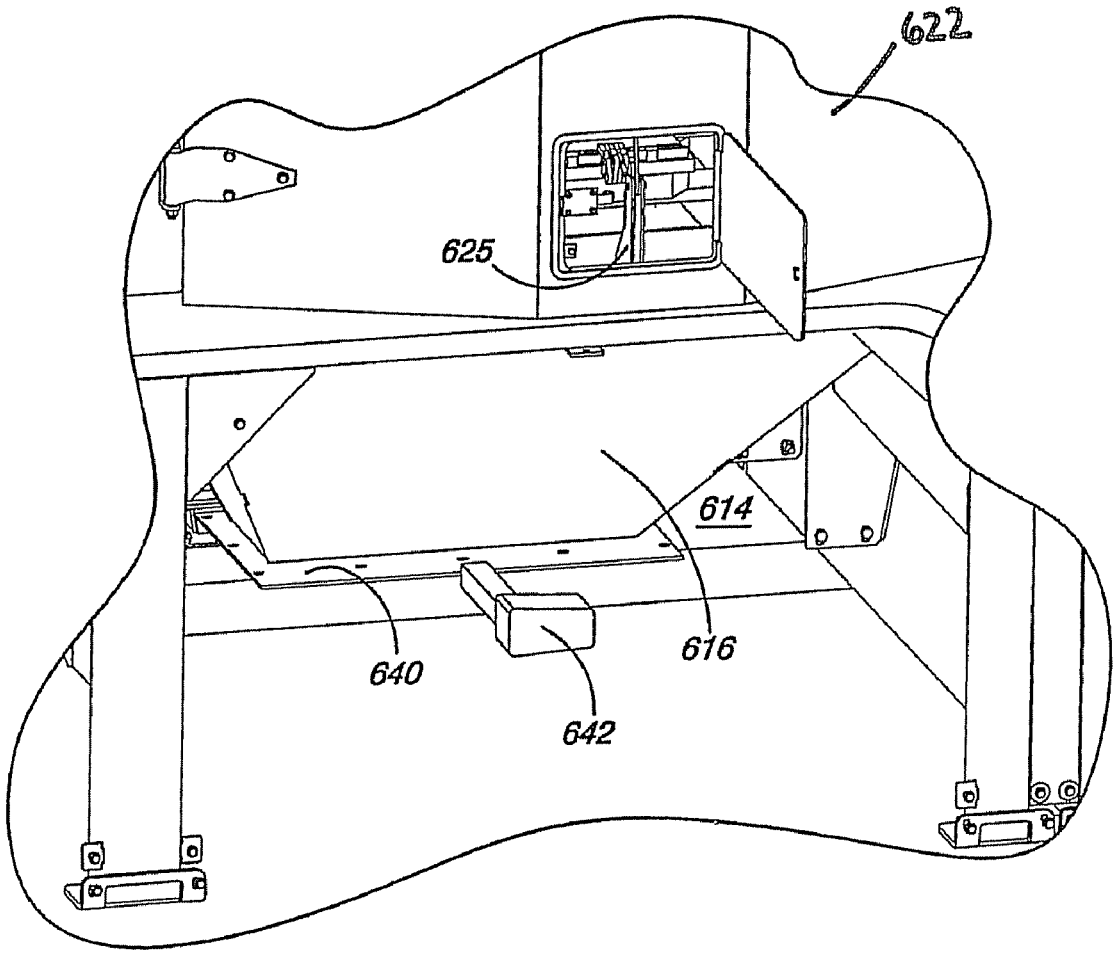
FIG. 6 illustrates an embodiment of a hopper slide gate through which product exits onto a horizontal conveyor of the product dispensing apparatus.

Referring to FIG. 4, container 422 includes an interior funnel hopper-like structure (not shown) featuring smooth sides and a funnel shape, e.g., cone-shape, for complete emptying without tipping. In one embodiment, container 422 also includes a side exit slide door, such that when opened the products contained in container 422 are emptied through the side of container 422. Container 422 also includes bottom exit slide door 423 as shown in its open position in FIG. 4. Bottom exit slide door 423 is opened and closed using a cable and pulley system 548, as shown in FIGS. 5A and 5B. An electric, air, or other type powered actuator 625, as shown in FIG. 6, is operably associated with bottom exit slide door 523 via clamp 527 and to programmable logic control (PLC) 128 (FIG. 1). It is recognized that it is within the scope of the disclosure to manually open slide door 523.

A source of compressed air (not shown) that serves the air powered actuator 625 can be connected to an output device (e.g., a hose) so as to provide pressurized air that can be operated by a user (e.g., an inventory provider) to clean out the storage receptacles of the dispensing apparatus before product has been placed in the receptacles by the inventory provider and after product has been removed by the end-user. The pressurized air so provided also can be used by inventory providers and end-users for other purposes related to dispensing product, e.g., increasing air pressure within tires of a transport vehicle after loading large quantities of product onto the transport vehicle. Making pressurized air available to users can increase the desirability of obtaining large quantities of product from the dispensing apparatus.

Referring to FIGS. 5A and 5B, the cable and pulley system 548 is operated by means of air cylinder 550. Cable and pulley system 548 includes air cylinder 550 operably connected to one end of cable 552. Cable 552 is mounted around pulley 554 which is held within bracket 558. The second end of cable 552 is attached to clamp 527, which is secured to exit slide door 523 by use of bracket 558. It is within the scope of the present disclosure to use any known mechanism and system now or hereafter known to open and close slide exit door 523.

According to the present disclosure, door 536 includes inner and outer panels creating a hollow cavity within. The container opening device 548 is located within the cavity of door 536.

In order to engage the automatic slide door 523 opener system of the disclosure, clamp 527 must be secured to slide door 523 of container 522. The individual delivering container 522 to receptacle 120 (FIG. 1) must close door 536 and open cavity access door 538 and side door (not shown) of container 522. Keeping slide door 523 in its closed position, the user secures clamp 527 to bracket 558 and slide door 523.

The process of opening exit slide door 523 is initiated by PLC 128, wherein in one embodiment a user ID and password is entered and instructions are provided to PLC 128 to open a particular exit slide door 523, an air compressor (not shown) supplies air pressure to retract air cylinder 550. Air cylinder 550 is in a fully extended position while the slide door 523 is in its closed position. Upon retraction of air cylinder 550, cable 552 moves in an outward direction pulling slide door 523 open. Therefore, the present disclosure also includes an automatic mechanism and method for opening slide door 523 of container 522, without having to modify container 522, wherein container 522 may be a standard Q-Bit PLUS™ or Q-Bit™ container currently used in the marketplace. However, it is to be understood that various other containers also may be used successfully in the apparatus and method of the present disclosure.

FIG. 1 further shows hopper 116. Hopper 116 is positioned below container 422 and container opening 429 (FIG. 4), such that when slide door 423 is opened, the product in container 422 falls into hopper 116. Hopper 116 is operably associated with slide gate 140. Slide gate 140 is further illustrated in FIGS. 6, 9A, and 9B, and is described in further detail below. Referring to FIG. 6, when slide gate 640 is opened, seed released from container 622 falls through discharge opening of hopper 616 onto horizontal conveyor 614. Horizontal conveyor 614 is continuous with or otherwise associated with vertical conveyor 112 (FIG. 1), such that seed from container 622 is conveyed up vertical conveyor 112 and released to the receiving container of the end-user, such as a truck box, seed wagon, or seed tender unit. In FIG. 1, vertical conveyor lift motor 113 operates to raise and lower vertical conveyor 112, it being understood that a manual hand winch can be used in place of lift motor 113. Thus, PLC 128 of hopper apparatus 110 causes the automatic opening of container 422 bottom exit door 423 (FIG. 4) and hopper slide gate 640 (FIG. 6) for delivery to the conveyor system comprising, in one embodiment of the disclosure, a horizontal conveyor 614 (FIG. 6) and vertical conveyor 112 (FIG. 1).

Figure 7:
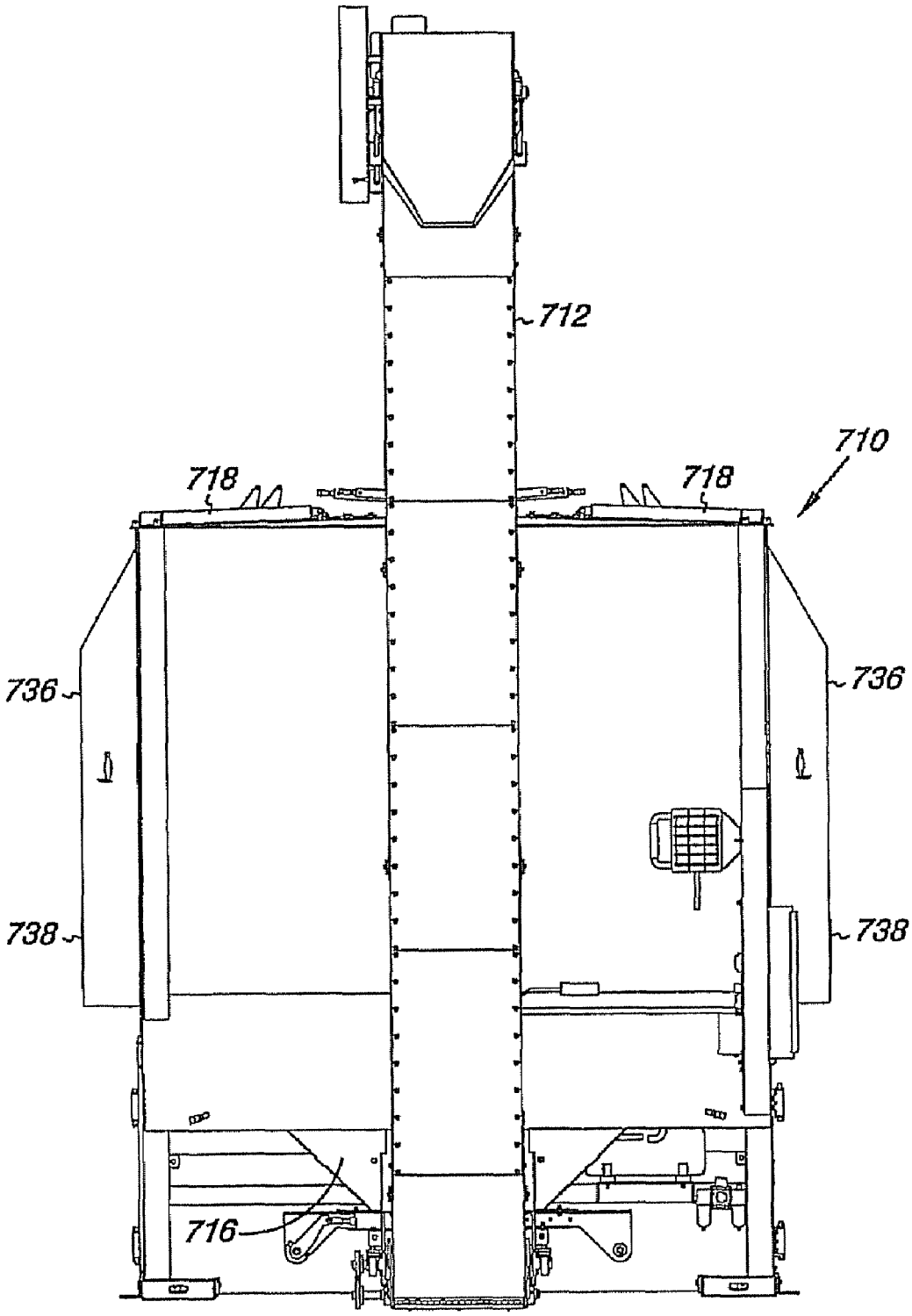
FIG. 7 illustrate an embodiment of an end of the apparatus with which a vertical conveyor is associated for dispersal of product.

Referring again to FIG. 1 along with the end view of FIG. 7, integral receptacle 120 is also designed to hold bulk product. Bulk product is loaded into receptacle 120 through fill access ports 118 and 718, respectively Each receptacle door, e.g., 536 in FIG. 5A and 736 in FIG. 7 includes a hatch door, e.g., 538 in FIG. 5B and 738 in FIG. 7.

Referring to FIG. 6, slide gate 640 is shown at the bottom of hopper 616. Slide gate 640 is linked to an air, electric or other type powered actuator 642. When slide gate 640 is in its closed position, product is held within hopper 616. When slide gate is opened, product is emptied onto horizontal conveyor 614, subsequently transferred to vertical conveyor, shown as 112 in FIG. 1, and is ultimately transferred to end-user container (not shown) located under the output end of vertical conveyor 112.

Slide gate 640 of the present disclosure is specially formed to actively discharge material stored in receptacle 120 or in a container 122 (FIG. 1). Solid bulk products (e.g., grain, seed, pellets, dry distillers grain, flour, milk powder, cement, clay and other non-liquid materials) tend to form a crust at the bottom discharge openings of bulk storage and transportation hoppers. Upon opening of the hopper gates, the gravity compaction of crust prevents the "mass flow" of product from the hopper.

Similarly, in some types of bulk materials, a densely packed bridge is often formed by settling of small particles, distribution of various particle sizes, moisture absorption, relative humidity, temperature, and vibrations during transport or storage and product cohesiveness. "Funnel compaction" results in the formation of stagnant compacted material around the sides causing material to flow through a small hole from the top of the hopper through the stagnant compacted material. This hole is referred to the industry as a "rat hole." Funnel compaction also prevents the mass flow of material through discharge opening of a hopper.

Figure 8:
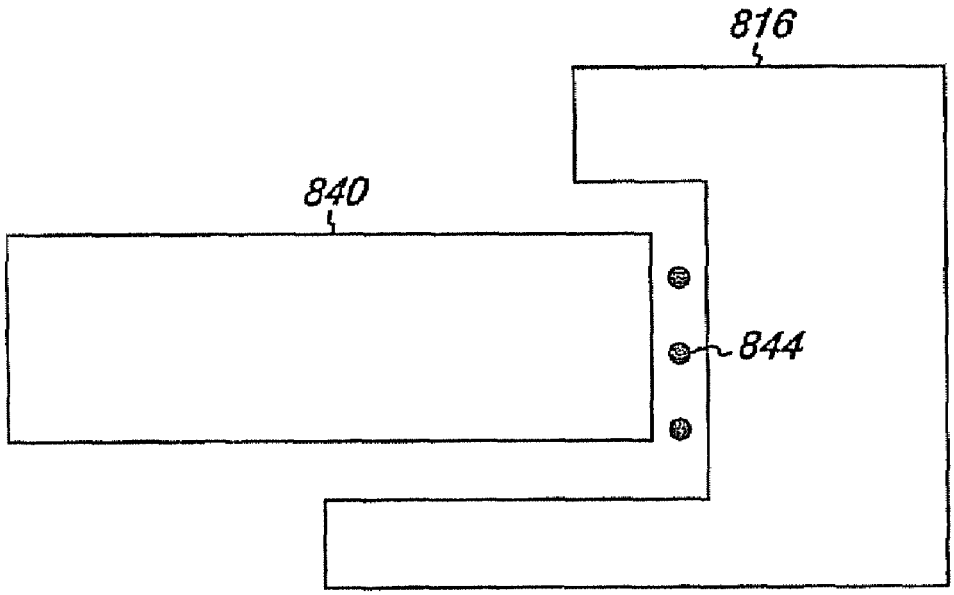
Fig. 8 (PRIOR ART)
FIG. 8 illustrates a prior art example of a current hopper slide gate closure mechanism.

A further problem with discharging materials stored in hoppers is that hopper gates are currently flat and formed on a substantially horizontal plane. Thus, even when fully open, stored material remains on top of the horizontal gate and often gets wedged 844 into the hopper slide gate (male) 840 and frame (female receptor) 816 as shown in FIG. 8 when closed.

As will be described in more detail next, embodiments of the present disclosure provide a slide gate 640 (FIG. 6) that upon sliding to its open position disturbs crust and funnel compacted material at and around the discharge opening, thereby freeing the product to mass flow through discharge opening to conveyor 614 below. As such, embodiments of the slide gate 640 according to the present disclosure are self-cleaning.

Figure 9A:
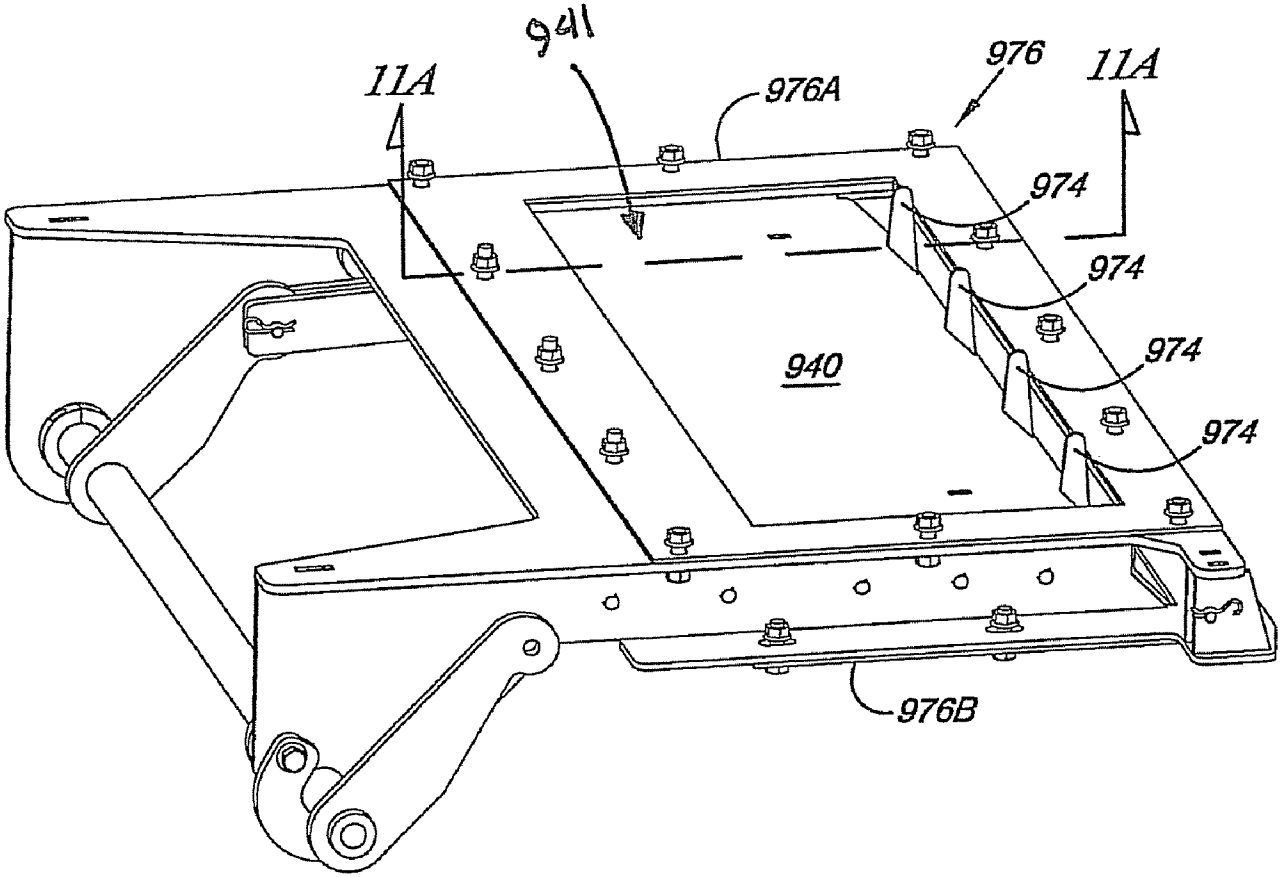
FIGS. 9A and 9B illustrate embodiments of a closed and an open hopper slide gate, respectively, with fingers, according to the present disclosure.
Figure 9B:
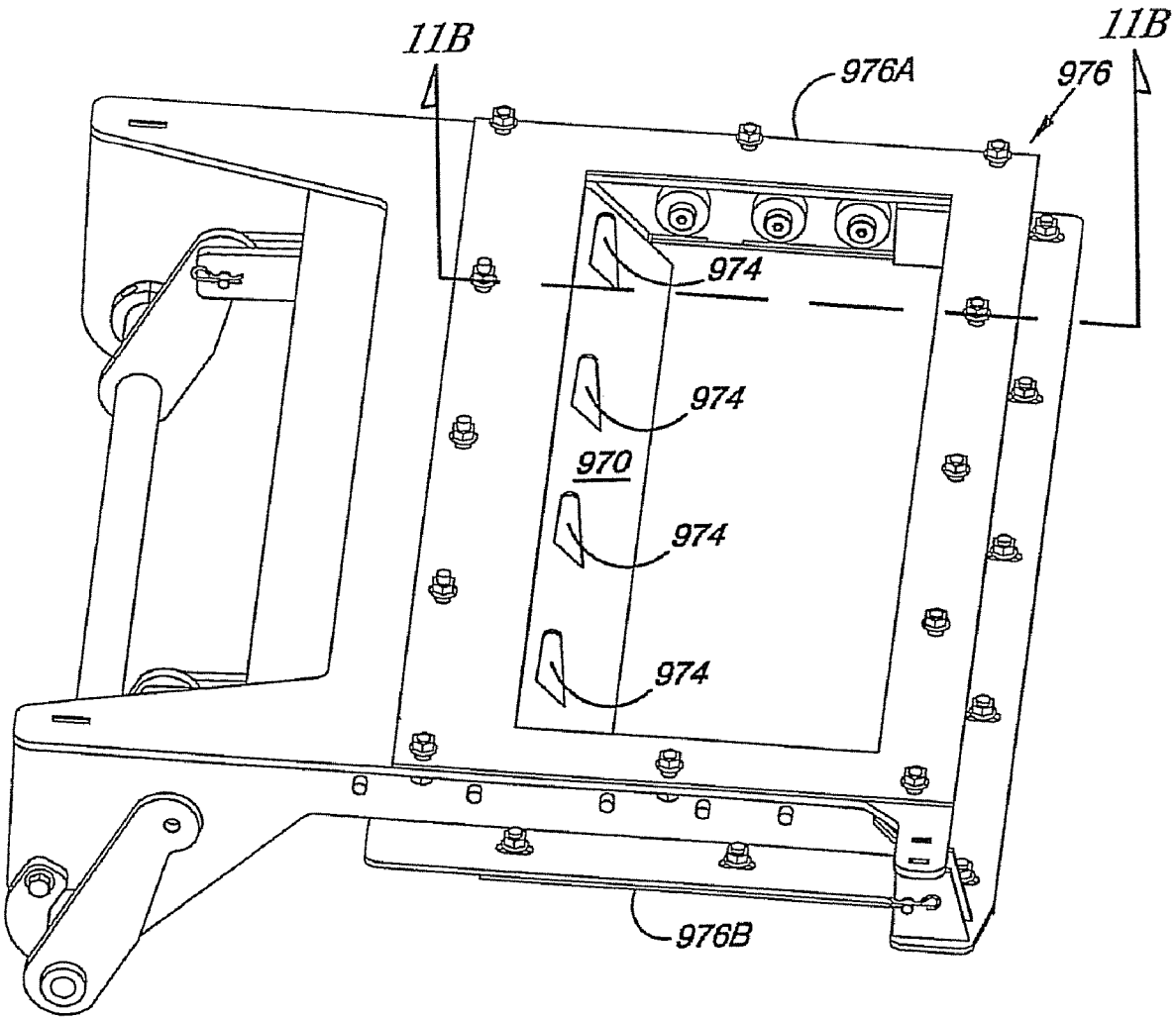
Figure 10:
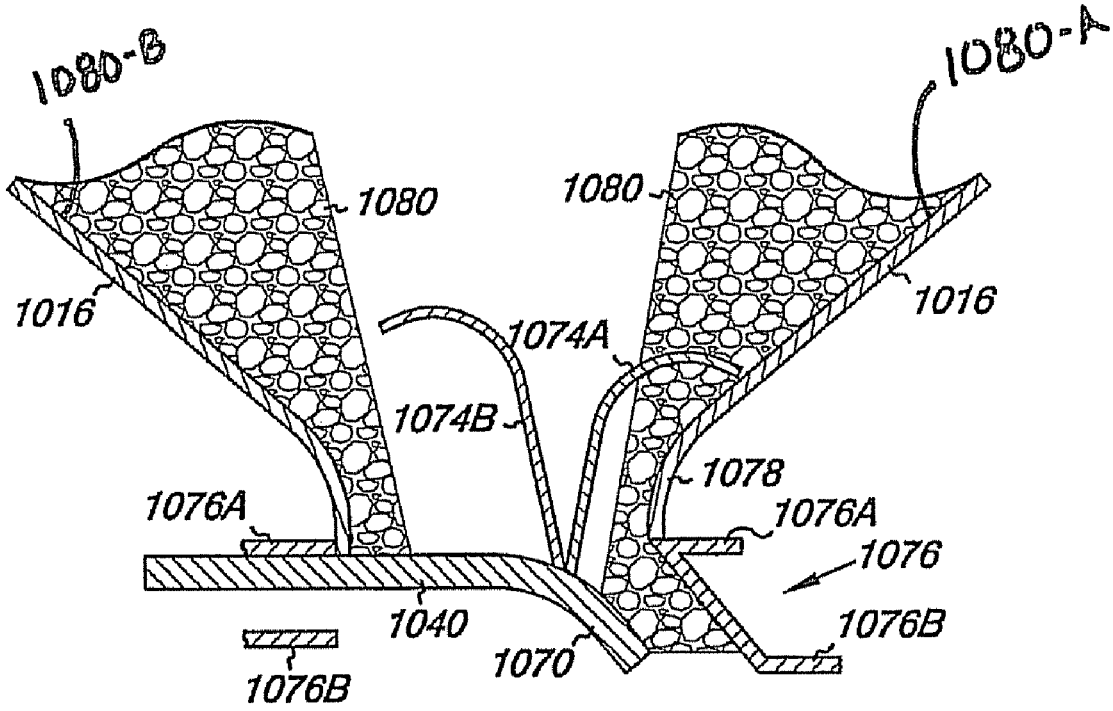
FIG. 10 illustrates an embodiment of a hopper slide gate with alternative finger configurations.

FIGS. 9A, 9B, and 10, illustrate in more detail embodiments of a hopper door 941 including a slide gate 940 and 1040, respectively, of the present disclosure. The hopper door 941 includes a frame 976, illustrated with a rectangular geometry, to which a hopper cone (shown as 616 in FIG. 6) can be mounted. Embodiments, however, are not limited to the particular rectangular frame geometry provided in this example. The frame 976 defines an opening above the slide gate 940 and can include a top member 976-A and a bottom member 976-B. The slide gate, e.g., 940, is disposed between the top member 976-A and the bottom member 976-B and can travel therebetween, e.g., on roller, bearings, etc., to be retractable between an open position (FIG. 9B) and a closed position (FIG. 9A). As shown in the embodiments, a set of fingers, e.g., 974 and 1074 respectively, project vertically from the slide gate 940 and 1040, respectively, to dislodge material from the hopper, e.g., hopper cone (shown as 616 in FIG. 6). The set of fingers 974 and 1074, respectively, are located on a leading edge 970 and 1070, respectively, of slide gate 940 and 1040, respectively, and extend upwards from the top of slide gate 940 and 1040, respectively, into hopper discharge opening. Depending on the product stored in hopper 116 and receptacle 120 (FIG. 1) and the type of flow problems, fingers 974 and 1074, respectively, can vary in length, diameter, number, and shape. For example, if the product is slightly damp grain that forms a crust, fingers 974 may be only a couple of inches long and be still effective in breaking the crust, as shown in FIGS. 9A and 9B.

However, referring to FIG. 10, if the product is dry distillers grain that discharges as a "funnel flow," fingers 1074 may be a foot or more in length and shaped like inverted spoons. Fingers 1074A and 1074B are pointed towards and away, respectively, from leading edge 1070 of slide gate 1040. When slide gate 1040 is opened, the forward pointing fingers 1074-A break through the crust, bridge or funnel compaction releasing the product for mass flow from the proximate interior wall 1080-A. Likewise, when slide gate 1040 is opening, the backward pointing fingers 1074-B break the bridge of funnel compaction formed on the opposing interior wall 1080-B of hopper 1016. The action of opening and closing of slide gate 1040 allows fingers 1074 to disrupt the compacted stored materials and allows for mass flow to a waiting conveyor 614 (FIG. 6) or other material receiving device.

As one of ordinary skill in the art will appreciate upon reading this disclosure the slide gate 940 and 1040, having a particular configuration to the set of fingers 974 and 1074, respectively, can be interchangeably replaced with another slide gate having a different particular configuration of the set of fingers, as suited to use with a particular product to be dispensed through the hopper, by opening the hopper door frame 976, e.g., disconnecting bolts connecting the top member 976-A to the bottom member 976-B and placing a different slide gate therebetween.

FIGS. 9A, 9B, 10, and 11 show that the present disclosure further provides a slide gate 940, 1040, and 1140, respectively, with a downwardly sloped leading edge 970, 1070, and 1170, resp, which may pass between the top member 976-A and bottom member 976-B of the frame 976 to seal the hopper discharge opening. The downwardly sloping leading edge, e.g., 970, provides the self-cleaning aspect of the present disclosure by allowing stored material to slide downward to conveyor 614 rather than remaining on top of the slide gate and/or remaining between the gate 940 and hopper frame 976 in FIG. 9.

The leading edge, e.g., 970, of the present disclosure is also bent for structural support. Bent metal, depending on the bend angle, has increased weight-bearing capacity compared to a flat metal structure. The slide gate 940 of the present disclosure has approximately three times the structural support capacity compared to a flat horizontal hopper gate. Providing a bend in the slide gate provides for two functions: self-cleaning and increased strength.

FIGS. 11A-11B and 11C-11D illustrate cross sectional views of the slide gate 1140 in operable combination with the hopper 1116 from a side view and top down view, resp., taken along cut-lines 11A-11A in FIG. 9A and cut-lines 11B-11B in FIG. 9B respectively.

Figure 11A:
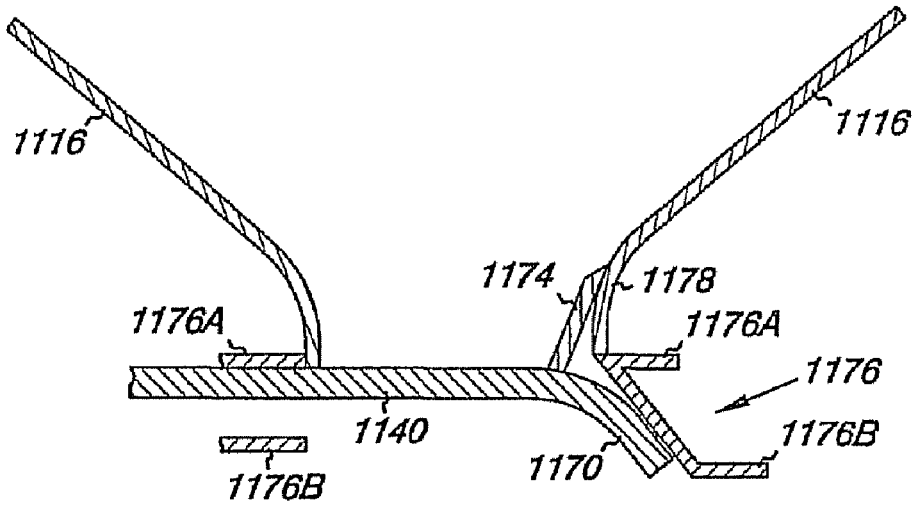
FIGS. 11A-11D illustrate embodiments of a hopper slide gate including top and side cross-sectional views taken along cut-lines 11A-11A and 11C-11C in FIGS. 9A and 9B.

FIG. 11A shows in further detail the side view for slide gate 1140, in a closed position, in operable combination with hopper 1116. As hopper slide gate 1140 closes, the vertical fingers 1174 closely approach or touch the hopper frame. The hopper door frame 1176 (illustrated as "frame" 976 from an above perspective view in FIGS. 9A and 9B) is bolted or otherwise secured to hopper 1116. When slide gate 1140 is fully in its closed position, the downwardly sloping leading edge 1170 can mate flush with the discharge periphery 1178 of the hopper cone 1116 and the hopper door frame 1176, e.g., "frame" 976 in FIGS. 9A and 9B. As mentioned in FIGS. 9A and 9B, the hopper can be secured to the hopper frame 1176 such that the leading edge 1170 of the slide gate 1140 can pass between a top member 1176-A and a bottom member 1176-B of the hopper door frame 1176. The fingers 1174 on the downward sloping leading edge 1170 of slide gate 1140 can mate flush with an inner wall of the hopper 1116 when the slide gate 1140 is in the closed position.

Figure 11B:
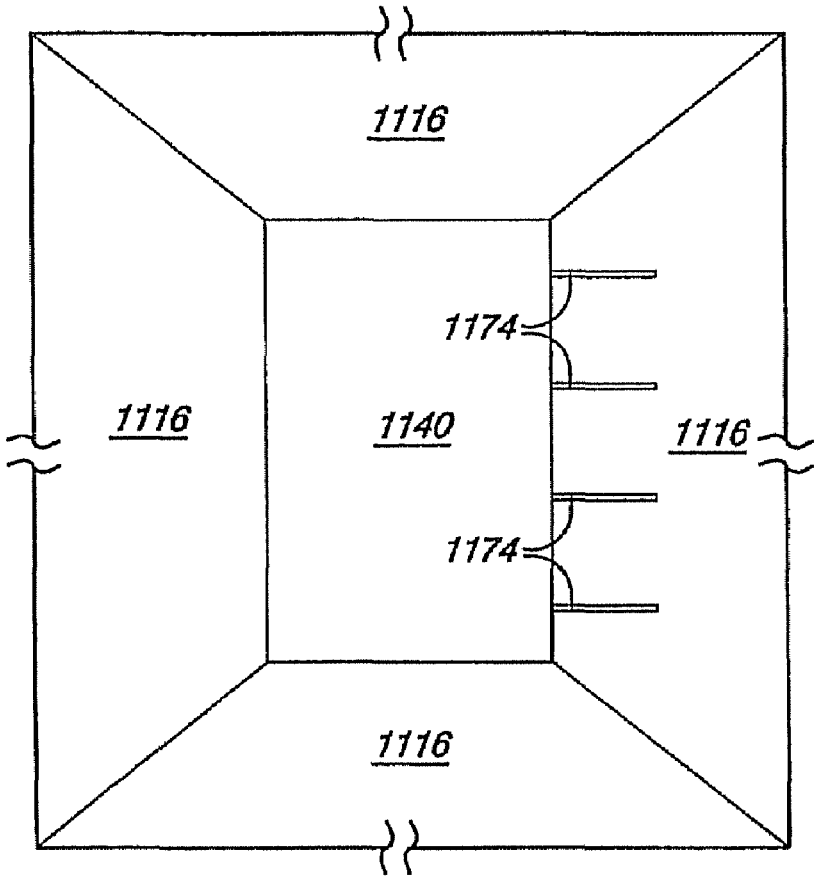

FIG. 11B illustrates a top down view of FIG. 11A when the slide gate 1140 is in the closed position. Hence, the view illustrates interior walls of the hopper 1116, a top surface of the slide gate 1140, and the set of fingers 1174 resting against the interior walls of the hopper 1116.

Figure 11C:
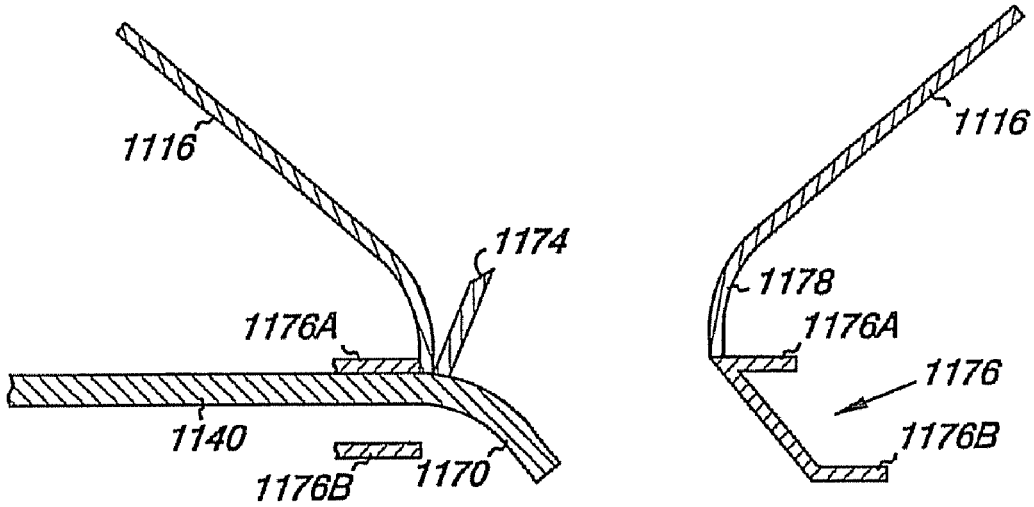

FIG. 11C shows in further detail the side view for slide gate 1140, in an open position, in operable combination with hopper 1116. As hopper slide gate 1140 opens, the vertical fingers 1174 move away from the hopper frame, e.g., interior walls of the hopper 1116. When slide gate 1140 is fully in its open position, the downwardly sloping leading edge 1170 can mate flush with opposing side of the hopper door frame 1176. The opposing sides of the hopper interior walls 1116 again are secured to the hopper frame 1176. As illustrated in the example embodiment of FIG. 11C, the leading edge 1170 of the slide gate 1140 can be retracted to stop in line with the opposing side of the hopper interior wall 1116 again at the hopper door frame 1176. The fingers 1174 on the downward sloping leading edge 1170 of slide gate 1140 will remain projecting into the hopper discharge opening.

Figure 11D:
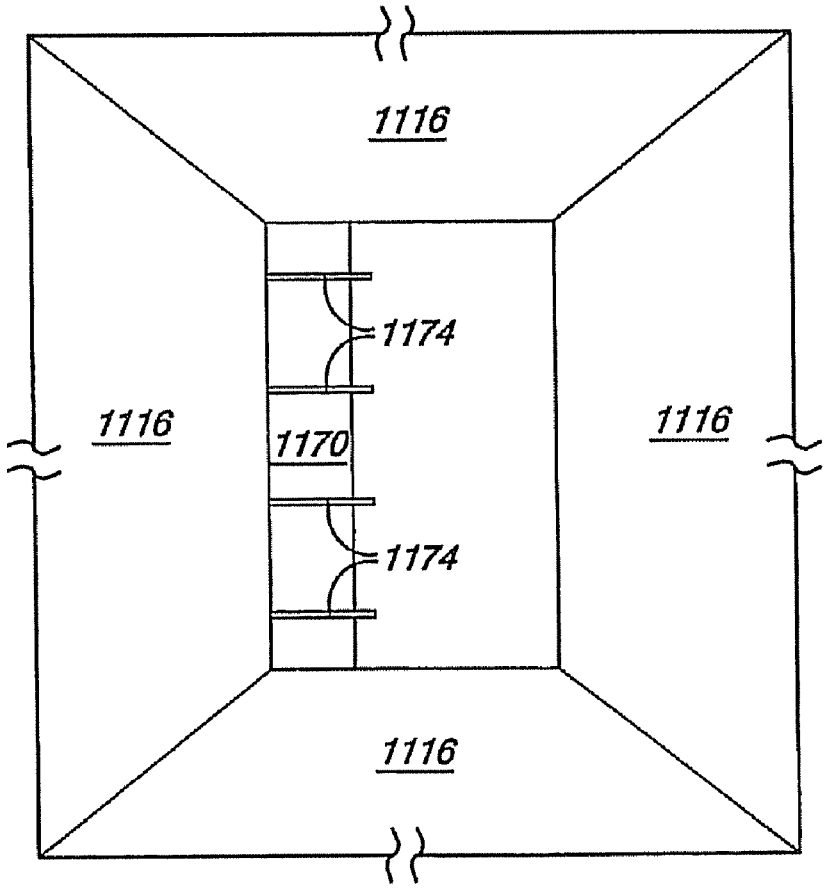

FIG. 11D illustrates a top down view of FIG. 11C when the slide gate 1140 is in the open position. Hence, the view illustrates interior walls of the hopper 1116, a top surface of the slide gate 1140, and the set of fingers 1174 resting against the interior walls of the hopper 1116.

Figure 12:
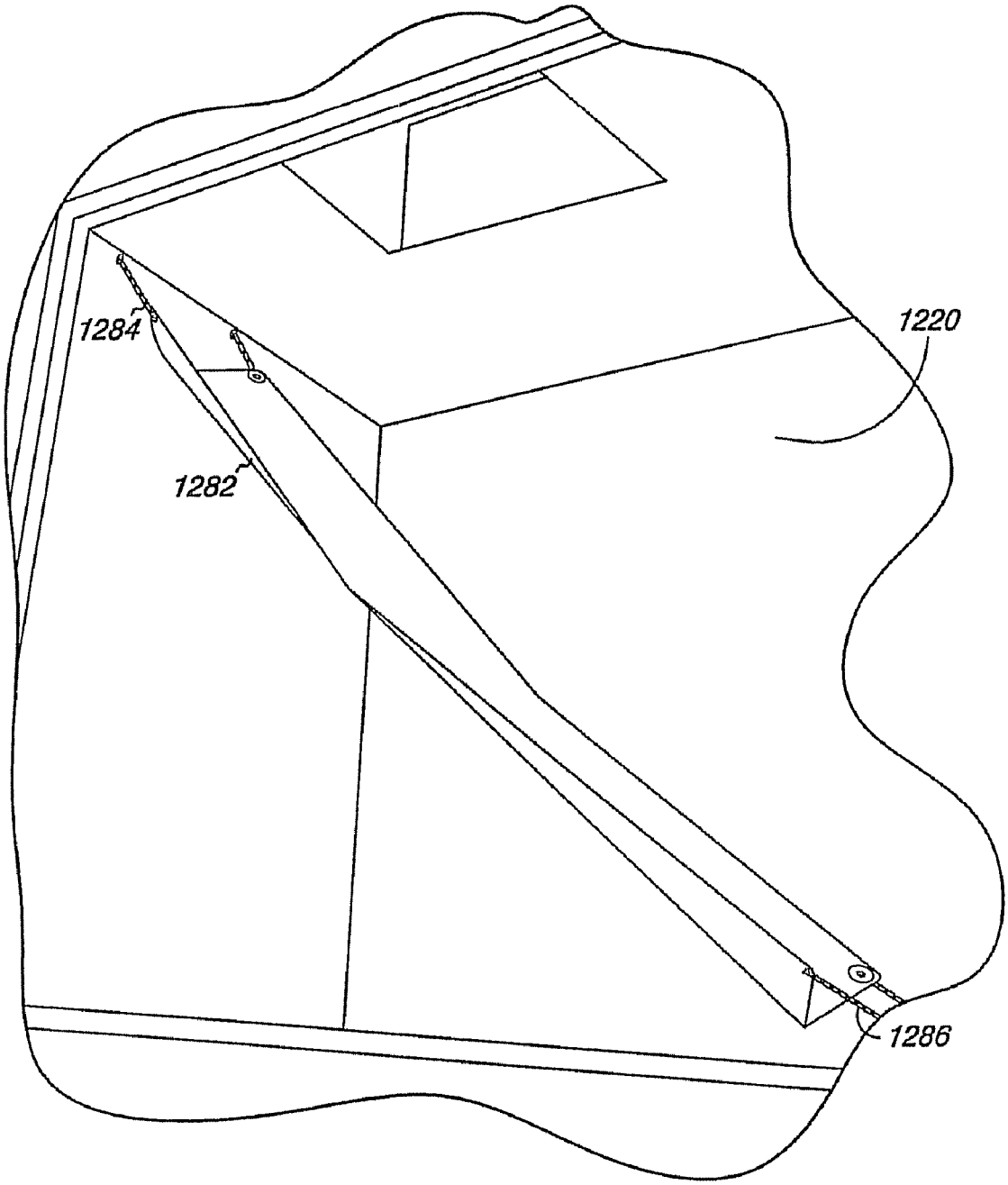
FIG. 12 illustrates an embodiment of a product deflector onto which product is loaded within a storage receptacle of the product dispensing apparatus.

FIG. 12 illustrates a product slide 1282 for gentler introduction of bulk material into receptacle 1220. Product slide 1282 is located directly below port 1218 and having one end attached to the upper portion of receptacle 1220 and a lower end attached to the lower end of receptacle 1220, thereby forming a slide. The slide catches bulk material being poured into port 1218 and gently slides the material, such as seed, into hopper 1216 and receptacle 1220, thereby preventing the material from physical damage. Product slide 1282 may be made out of standard conveyor or other materials and is attached to container by appropriate means known to those skilled in the art. In the embodiment shown in FIG. 12, product slide 1282 is attached to receptacle 1220 by chain and link.

FIG. 1 shows locker 126, wherein packaged products (e.g., bags containing seed, chemical, fertilizer, etc.) ordered from an inventory provider are stored for pick up according to the method of the disclosure.

FIG. 1 also shows one embodiment of the hopper apparatus 110 having rows of paired receptacles. Any number of receptacles of different shapes and sizes and in numerous physical arrangements are within the scope of this disclosure.

In general, the method of the disclosure provides a unique system for end-users to order products from an inventory provider and self-service pick up of those products at a site remote from the inventory provider at any time of the day and week. In practice, an end-user calls an inventory provider with an order. The end-user is provided with an end-user access code. An end-user broadly means any person that orders product(s) from an inventory provider. The inventory provider can communicate with PLC 128 of the hopper apparatus 110 (FIG. 1) of the disclosure. Communication is facilitated by any communication means now or hereafter known. For example, communication devices and systems can include land or mobile telephones and systems, computers, and/or the internet. The inventory provider calls PLC 128 to check the vacant container capacity of hopper apparatus 110. PLC 128 determines the status of its various storage container units (i.e., receptacles 120, lockers 126, and pallet lockers 132) and provides that information to the inventory provider. Collection, storage, and communication of data can be accomplished in numerous ways known by those persons skilled in the art. For example, in one embodiment of the disclosure, PLC 128 and inventory provider may link with a website containing data relating to hopper apparatus 110, end-user, and product information. The inventory provider can then reserve various hopper apparatus 110 storage container units for subsequent delivery of product ordered by an end-user. It is understood that more than one inventory provider may have use of and access to the hopper apparatus and method of the disclosure.

The inventory provider then arranges for the product ordered by the end-user to be delivered via delivery truck or other vehicle to the hopper apparatus 110. The hopper apparatus 110 is typically located at a remote site, closer to the activity of the product end-users. However, it is within the scope of the disclosure that it can be located at the inventory provider site, such that end-users can obtain product at that site outside of business hours.

Upon arrival at the hopper apparatus, a person with knowledge of the end-user code will typically interact with the PLC 128 by entering the previously assigned end-user codes, which will cause the receptacles 120, lockers 126, and pallet lockers 132 that were previously reserved by the inventory provider for the particular end-user order to open for insertion of the bulk products and product packages. By requiring the inventory provider to enter the end-user code, a cross-check is integrated into the method of the disclosure, whereby the cross-check insures that correct products get into the correct compartments, which insures that the end-users obtain the correct products when they enter in their end-user code.

For delivery of bulk seed to receptacle 120, the person opens ports 118 and inputs the product into receptacle 120. It is contemplated that the hopper apparatus of the disclosure also can be located adjacent a large fixed seed storage bin, such as a TruBulk™ bulk delivery system (Syngenta Seeds, Inc.). Transfer of seed ordered by an end-user to hopper apparatus 110 can be implemented by a seed delivery conduit removably interconnecting the TruBulk™ bulk delivery system and fill access port 118 of hopper apparatus 110.

For insertion of a large container 122 into receptacle 120, door 736 (FIG. 7) is opened. Typically, a forklift is needed to insert large container 122 into receptacle 120. The end-user access code corresponding to the particular receptacle 120, lockers 126, and pallet lockers 132 that contains the end-user product is entered into the PLC 128. The entry of the end-user code can be input into the PLC 128 at any time after the inventory provider receives the order. The inventory provider must engage the bottom exit door 523 (FIG. 5) to clamp 527 by manually unlocking safety latch 124 (FIG. 1) and hooking clamp 527 to bottom exit door 423.

To determine if the product(s) that the end-user has ordered is stored in the hopper apparatus, the end-user communicates with the PLC 128 via internet, phones, the web, or other means and enters his or her access code. Upon receiving the access code, the PLC 128 will indicate to the user whether delivery has occurred. According to the disclosure, the end-user can determine product delivery status any day and time. Furthermore, the end-user can take delivery of the product contained from hopper apparatus 110 any day and time. The hopper apparatus 110 of the disclosure is self-service for the end-user and automatic, not needing anyone representing the inventory provider to be present during transfer of the products to the end-user.

Upon arriving at the hopper apparatus 110, the end-user enters his or her access code into the PLC 128. The PLC will communicate to end-user where the products are stored within the hopper apparatus 110. For example:

TABLE 1

| | |
|---|---|
| Bulk hybrid seed 5432 (90 units) | Compartment A |
| Bulk hybrid seed 7654 (120 units) | Compartment B |
| Hybrid seed 3210 (50 bags) | Compartment C |
| Hybrid Seed 4321 (5 Bags) | Compartment D |
| Chemical 8921 (3 bags) | Compartment E |

Referring to Table 1, the end-user selects one product for delivery, for example bulk hybrid seed 5432, wherein the PLC 128 will ask if truck box, seed wagon, seed tender unit, or other receiving container is in its proper place under the output end of conveyor 112. When the end-user indicates that the truck is in place, the PLC 128 will indicate to the appropriate actuator(s) to open the respective sliding doors, wherein the 90 units of hybrid seed 5432 within Compartment A is conveyed to the waiting container.

However, prior to delivery, the grower may be required to accept all legal disclaimers for the particular product as indicated by the PLC 128. Furthermore, it is within the scope of the present disclosure to require that end-user agree to contract terms. For example, in the agriculture industry, PLC 128 would provide contract language that the end-user must accept, requiring the end-user to abide by certain Integrated Resistance Management practices.

Again referring to Table 1, the end-user repeats the process for the hybrid seed 7654, also stored in bulk within hopper apparatus 110. As already described above, bulk product is stored freely within receptacle 120 or within large container 122 residing in receptacle 120. As is evident from FIG. 1, storage capacity of produce stored freely within receptacle 120 is larger than the storage capacity of large container 122 residing within receptacle 120.

The PLC 128 includes a screen and input device such as a key pad (not shown) for display and input of information. It is also within the scope of the disclosure to allow end-user access to the hopper apparatus 110 by using a credit card or other card that identifies the end-user. Once the end-user has agreed to the terms of the purchase, the end-user indicates to the PLC 128 that the truck is in place, and ownership of the product immediately passes from the inventory provider to the end-user.

By way of example, if the product selected is contained in container 122 or directly in receptacle 120, the PLC 128 causes the conveyor to start and the actuator(s) to open the respective slide doors 423 (FIG. 4) and/or 940 (FIGS. 9A and 9B). The PLC 128 runs the conveyors until a flow sensor (not shown) tells the PLC 128 that receptacle 120 is empty. Once the sensors indicate that the receptacle 120 is clear of the product, the PLC 128 sends a signal causing the respective slide doors 423 and/or 940 to close. The conveyor belts 112 and 114 are run, however, an extra time to ensure complete exit of the product, after which they are stopped.

As product enters conveyor belt 112, application of another product (e.g., inoculants, fertilizer, pesticides, emulsifiers, coatings, treatments, etc.) can be applied to the product before exiting into the end-users receptacle.

To continue transferring end-user products identified in Table 1, the end-user selects hybrid seed 3210 (50 bags). The 50 bags contained in Compartment C would likely be stored in a pallet locker 132 (FIG. 1). The PLC 128 will ask if the end-user is ready to take delivery of the pallet. When the end-user indicates that he or she is ready to take delivery, the PLC 128 will instruct the appropriate actuator to unlock the appropriate pallet locker 132 door, wherein the end-user removes the pallet, typically by a forklift, for loading of a truck box or other receiving container. End-user continues transferring the products contained in Compartments D and E. The packaged products contained in Compartments D and E would be stored in package lockers 126 (FIG. 1). To unload package Hybrid Seed 4321 and Chemical 8921 from package lockers 126, end-user simply repeats the steps used to transfer the products contained in Compartment C.

End-user still needs to take delivery of the remaining articles. For delivery of bulk articles contained freely within receptacle 120 or in container 122, end-user follows the method already describe above. For packaged items that are stored in a locker 126, end-user again enters in his or her access code, which may be a different access code for each compartment accessed by the end-user, accepts all legal disclaimers, contract terms, etc. Referring to the example products listed in Table 1, the end-user selects Hybrid Seed 4321 Bags indicator on the PLC 128. Once the end-user selects the product, ownership passes from the inventory provider to the end-user. The PLC 128 then causes the locker door to unlock. The end-user removes the packages from the locker and loads them into a vehicle.

Once the end-user removes the products he or she previously ordered, the end-user indicates to the PLC 128 that the transaction is complete. The PLC 128 will cause a receipt to be printed out. The end-user can also request additional information to be printed out, for example, product specifications, relevant federal and state regulations, and instructions. As is understood in the art, any type of information can be input and stored in the PLC 128 and printed out for the benefit of the end-user. It is recognized that the PLC 128 can function as an information center, wherein local news, industry events, special sales, weather, etc., are provided to the end-user. For example, PLC 128 may provide the end-user with current grain commodity prices.

It is customary for end-users to produce products (e.g., grain) from the original product (e.g., seed) dispensed from the disclosure apparatus. This disclosure can be used to reverse the transaction, wherein the end-user is given an access code to load product (e.g., grain) into container 122 or in receptacle 120. The originating inventory provider (dealer), or designee, can receive products from the end-user by being dispensed by belt conveyor 112.

The foregoing disclosure has been described in detail by way of illustration and example for purposes of clarity and understanding. However, it will be obvious that certain changes and modifications may be practiced within the scope of the disclosure, as limited only by the scope of the appended claims.

What is claimed is:

1. A dispensing system, comprising:

a hopper storage receptacle;

a conveyor mechanism;

a hopper door associated with the hopper storage receptacle to controllably release product from the hopper storage receptacle to the conveyor mechanism based on a unique access code associated with an end product user and assigned to a product order in advance of providing product to the hopper storage receptacle; and wherein the hopper door, comprises: a frame having a top member and a bottom member; a slide gate disposed between the top member and the bottom member and retractable between an open position and a closed position, wherein the slide gate includes a downwardly sloped portion angled from a horizontal position of the frame; and a set of fingers projecting from the slide gate to dislodge material proximate the hopper door.

2. The dispensing system of claim 1, wherein the dispensing system includes a programmable logic control (PLC) device having a user interface to receive the unique access code from an inventory provider, and wherein the PLC device is capable of sending to and receiving data from an inventory provider.

3. The dispensing system of claim 2, wherein the PLC device is capable of receiving data from and sending data to the end product purchaser via the user interface.

4. The dispensing system of claim 3, wherein the system includes a printer linked to the PLC device to provide a receipt to the end product user.

5. The dispensing system of claim 2, wherein the PLC is configured to accept reservation of the hopper storage receptacle based on the access code for future delivery of the product by the inventory provider.

6. The dispensing system of claim 5, wherein the user interface of the PLC is configured to receive the access code from the inventory provider to open the hopper door for delivery of the product to the hopper storage receptacle.

7. The dispensing system of claim 6, wherein the user interface of the PLC is configured to receive the access code from the product end user to open the hopper door for release of the product from the hopper storage receptacle after delivery of the product to the hopper storage receptacle has occurred.

8. The dispensing system of claim 1, wherein the hopper storage receptacle includes a removable floor supported by a package support base such that when the removable floor is present the hopper storage receptacle can support packaged products and when the removable floor is not present loose product can be gravity fed to proximate to the hopper door.

9. The dispensing system of claim 8, wherein the package support base includes a crossbar rail structure.

10. The dispensing system of claim 1, wherein the hopper storage receptacle is configured to accept a gravity fed container having an access sliding door associated with an actuator and controllable by the PLC device to release product proximate to the hopper door.

11. The dispensing system of claim 1, wherein the hopper storage receptacle is configured to attach a product slide to attenuate a descent rate of product loaded through a top portion of the hopper storage receptacle.

12. The dispensing system of claim 1, wherein the system includes an air compressor and air hose attachment for use by a product purchaser.

13. The dispensing system of claim 1, wherein the set of fingers are configured to point in alternating forward and backward directions to dislodge material from the hopper structure.

* * * * *

UNITED STATES PATENT AND TRADEMARK OFFICE

CERTIFICATE OF CORRECTION

PATENT NO. : 7,640,075 B2
APPLICATION NO. : 11/332963
DATED : December 29, 2009
INVENTOR(S) : Gary W. Wietgrefe It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 666 days.

Signed and Sealed this

Ninth Day of November, 2010

David J. Kappos

David J. Kappos
*Director of the United States Patent and Trademark Office*